US012276058B2

(12) United States Patent
Son

(10) Patent No.: US 12,276,058 B2
(45) Date of Patent: Apr. 15, 2025

(54) EMBROIDERY MACHINE THREAD TENSION ADJUSTING DEVICE

(71) Applicant: MOBASE SUNSTAR CO., LTD, Incheon (KR)

(72) Inventor: Byeong Jun Son, Seoul (KR)

(73) Assignee: MOBASE SUNSTAR CO., LTD, Incheon (KR)

( * ) Notice: Subject to any disclaimer, the term of this patent is extended or adjusted under 35 U.S.C. 154(b) by 0 days.

(21) Appl. No.: 18/289,709

(22) PCT Filed: Dec. 29, 2021

(86) PCT No.: PCT/KR2021/020100
§ 371 (c)(1),
(2) Date: Nov. 6, 2023

(87) PCT Pub. No.: WO2022/234921
PCT Pub. Date: Nov. 10, 2022

(65) Prior Publication Data

US 2024/0254671 A1 Aug. 1, 2024

(30) Foreign Application Priority Data

May 7, 2021 (KR) ..... 10-2021-0059096

(51) Int. Cl.
*D05C 11/10* (2006.01)
*D05C 5/02* (2006.01)
*D05C 11/06* (2006.01)

(52) U.S. Cl.
CPC ..... *D05C 11/10* (2013.01); *D05C 5/02* (2013.01); *D05C 11/06* (2013.01)

(58) Field of Classification Search
CPC ..... D05C 11/08; D05C 11/10; D05C 5/02; D05C 11/06; D05B 47/04
See application file for complete search history.

(56) References Cited

U.S. PATENT DOCUMENTS 3,994,245 A * 11/1976 Smith ..... D05C 15/18 200/61.18
4,215,641 A * 8/1980 Dobrjanskyj ..... D05B 49/02 112/278

(Continued)

FOREIGN PATENT DOCUMENTS

KR 20-0298706 Y1 12/2002
KR 10-2003-0073656 A 9/2003

(Continued)

*Primary Examiner* — Danny Worrell
(74) *Attorney, Agent, or Firm* — Bridgeway IP Law Group, PLLC; Sang Ho Lee; Hyun Woo Shin

(57) ABSTRACT

The present invention relates to an embroidery machine thread tension adjusting device. An embroidery machine thread tension adjusting device according to an embodiment of the present invention is provided for an embroidery machine comprising a needle bar, a thread take-up unit, a hook, and an embroidery frame, and is configured to adjust the tension of an upper thread withdrawn from a spool and supplied to a needle of the needle bar through the thread take-up unit. The embroidery machine thread tension adjusting device comprises: a thread pulling adjusting unit comprising a thread take-up lever disposed along a path of movement of the upper thread withdrawn from the spool and supplied to the needle so as to control the amount of pulling of the upper thread when rotating while maintaining contact with the upper thread, and a first actuator for providing the thread take-up lever with rotational driving power; at least one thread guide adjusting unit comprising a pair of thread guide units disposed on at least one of the front and rear ends of the thread pulling adjusting unit along the path of movement of the upper thread such that, when the upper thread passes, same are forced against each other while maintaining contact with the upper thread, thereby controlling frictional force of the upper thread, and a second actuator for providing the pair of thread guide units with driving power; and a controller for determining the status of driving of at least one of the needle bar, the needle take-up unit, the hook, and the embroidery frame according to each of multiple pieces of stitch information included in embroidery data, and controlling the driving of at least one of the first actuator and the second actuator provided in each of the at least one thread (Continued)

guide adjusting unit according to the result of determination, thereby adjusting at least one of the amount of pulling of the thread take-up lever and the frictional force of the upper thread supplied between the pair of thread guide units provided in each of the at least one thread guide adjusting unit.

6 Claims, 7 Drawing Sheets

(56) References Cited

U.S. PATENT DOCUMENTS 4,688,501 A * 8/1987 Mikuni ..... D05B 49/02 112/254
6,047,653 A * 4/2000 Cash ..... D05B 49/02 112/181
11,795,594 B2 * 10/2023 Azuma ..... D05B 49/02
2007/0261619 A1 * 11/2007 Pak ..... D05C 11/08 112/97
2013/0125802 A1 * 5/2013 Takizawa ..... D05B 47/04 112/245

FOREIGN PATENT DOCUMENTS

KR 10-2006-0048275 A 5/2006
KR 10-2013-0037567 A 4/2013
KR 10-2013-0052488 A 5/2013
KR 10-2013-0052496 A 5/2013
KR 10-2013-0077214 A 7/2013
KR 10-1460943 B1 11/2014
WO 2017/006226 A1 1/2017

* cited by examiner

EMBROIDERY MACHINE THREAD TENSION ADJUSTING DEVICE

TECHNICAL FIELD

The present invention relates to an embroidery machine thread tension adjusting device, and more particularly, to an embroidery machine thread tension adjusting device that adjusts tension of an upper thread more easily and precisely by considering the supply speed of the upper thread and the amount of consumption of the upper thread for various types of upper threads, thereby preventing the upper thread from breaking, smoothly performing the supply of the upper thread, and improving embroidery quality.

BACKGROUND ART

In general, an embroidery machine refers to a mechanical device that embroiders a pattern desired by a user by moving a embroidery frame holding fabric in the X-axis and Y-axis directions while a needle bar moves up and down. The embroidery machine includes at least one sewing machine arm provided with a needle bar, a thread take-up unit, etc., a rotary hook base provided on each sewing arm and provided with a hook, etc., an embroidery frame, and an X-Y transfer system for driving the same. Each sewing machine arm may be provided with at least one needle bar as many threads of desired colors.

Meanwhile, in order to improve product quality, an embroidery machine needs to apply appropriate tension to an upper thread withdrawn from a spool and supplied to a needle. For this purpose, a thread tension adjusting device is installed therein.

For example, Korean Utility Model Registration No. 20-0298706 (MULTI-HEAD AUTOMATIC EMBROIDERY MACHINE WITH THREAD GUIDE SPRING MOUNTED THEREON) (published on Dec. 27, 2002), Korean Patent Application Laid-Open No. 10-2013-0052488 (THREAD TENSION ADJUSTER AND EMBROIDERY MACHINE THREAD TENSION ADJUSTING DEVICE INCLUDING THE SAME) (published on May 22, 2013), etc. disclose a structure of a conventional thread tension adjusting device.

FIG. 1 is a diagram showing an example of a conventional thread tension adjusting device provided in an embroidery machine.

FIG. 1 shows a conventional thread tension adjusting device shown in FIG. 5, etc. of Korean Utility Model Registration No. 20-0298706. That is, as shown in FIG. 1, the conventional thread tension adjusting device includes a main tension adjusting device and an auxiliary tension adjusting device provided on a thread tension adjusting plate of a sewing machine arm. The main tension adjusting device and the auxiliary tension adjusting device are disposed at appropriate positions along a path of movement of an upper thread. In this case, the main tension adjusting device adjusts the tension of the upper thread by a thread take-up spring, and the auxiliary tension adjusting device adjusts the tension of the upper thread by a pair of thread guide units.

However, in the conventional thread tension adjusting device, an operator manually adjusts the tension of the upper thread on the thread take-up spring or the tension of the upper thread passing between the pair of thread guides (i.e. frictional force caused by spring pressure) by using a control dial, etc. Therefore, there was a problem in that adjusting the tension of the upper thread is cumbersome and the tension of the upper thread is not adjusted consistently depending on an operator's skill level, which reduces accuracy.

In order to solve such problems, a structure of a thread tension adjusting device for adjusting tension of an upper thread by using various actuators has been introduced.

For example, Korean Patent Application Laid-Open No. 10-2013-0077214 (AUTOMATIC THREAD TENSION ADJUSTING DEVICE) (published on Jul. 9, 2013), Korean Patent Application Laid-Open No. 10-2013-0037567 (THREAD TENSION ADJUSTING DEVICE FOR SEWING MACHINE) (published on Apr. 16, 2013), etc. disclose a structure that adjusts tension applied to an upper thread by controlling pressure between thread guide press plates 306 through driving of a solenoid and implementing a thread take-up spring in an integrated form.

However, the thread tension adjusting devices described in the prior art documents have limitations to precise tension adjustment in that the tension of the upper thread passing between a pair of thread guide units (i.e., pressing force of the thread guide unit) is simply adjusted, the thread take-up spring still relies only on its own elastic force, and the tension of the upper thread is adjusted without considering the supply speed of the upper thread and the consumption amount of the upper thread.

Therefore, there is a need for an embroidery machine thread tension adjusting device that adjusts tension of an upper thread more easily and precisely by considering the supply speed of the upper thread and the consumption amount of the upper thread for various types of upper thread, thereby preventing the upper thread from breaking, smoothly performing the supply of the upper thread, and improving embroidery quality.

SUMMARY OF INVENTION

Technical Problem

The present invention has been made in an effort to improve the problems described above, and an objective to be achieved by the present invention is to provide an embroidery machine thread tension adjusting device that separately includes a thread pulling adjusting unit for adjusting an amount of pulling of an upper thread by an actuator, and thread guide adjusting units for providing a pair of thread guide units with pressing force by an actuator. By automatically controlling the driving of the thread pulling adjusting unit and the thread guide adjusting units according to the status of driving of a needle bar, a thread take-up unit, a hook, and an embroidery frame, the embroidery machine thread tension adjusting device according to an embodiment of the present invention may adjust the tension of the upper thread more easily and precisely by considering the speed of supply of the upper thread and the amount of consumption of the upper thread for various types of the upper thread, thereby preventing the upper thread from breaking, supplying the upper thread smoothly, and improving embroidery quality.

The objectives of the present invention are not limited to those described above, and other objectives that are not mentioned herein will be clearly understood from the following description by those of ordinary skill in the art.

Solution to Problem

In order to achieve the objective described above, an embroidery machine thread tension adjusting device according to an embodiment of the present invention, which is provided for an embroidery machine including a needle bar, a thread take-up unit, a hook, and an embroidery frame and is configured to adjust the tension of an upper thread withdrawn from a spool and supplied to a needle of the needle bar through the thread take-up unit, includes: a thread pulling adjusting unit including a thread take-up lever disposed along a path of movement of the upper thread withdrawn from the spool and supplied to the needle so as to control the amount of pulling of the upper thread when rotating while maintaining contact with the upper thread, and a first actuator for providing the thread take-up lever with rotational driving power; at least one thread guide adjusting unit including a pair of thread guide units disposed on at least one of the front and rear ends of the thread pulling adjusting unit along the path of movement of the upper thread such that, when the upper thread passes, same are forced against each other while maintaining contact with the upper thread, thereby controlling frictional force of the upper thread, and a second actuator for providing the pair of thread guide units with driving power; and a controller for determining the status of driving of at least one of the needle bar, the needle take-up unit, the hook, and the embroidery frame according to each of multiple pieces of stitch information included in embroidery data, and controlling the driving of at least one of the first actuator and the second actuator provided in each of the at least one thread guide adjusting unit according to the result of determination, thereby adjusting at least one of the amount of pulling of the thread take-up lever and the frictional force of the upper thread supplied between the pair of thread guide units provided in each of the at least one thread guide adjusting unit.

In particular, the controller sets an initial angular position of the thread take-up lever for each of the multiple pieces of stitch information, and then controls the driving of the first actuator such that the thread take-up lever maintains the initial angular position during one cycle where the needle bar is reciprocally driven.

In addition, the at least one thread guide adjusting unit includes: a first thread guide adjusting unit disposed on the front end of the thread pulling adjusting unit along the path of movement of the upper thread and guiding the upper thread drawn from the spool and supplied to the thread pulling adjusting unit; and a second thread guide adjusting unit disposed on the rear end of the thread pulling adjusting unit along the path of movement of the upper thread and guiding the upper thread supplied from the thread pulling adjusting unit to the thread take-up unit.

For each of the multiple pieces of stitch information, the controller controls the driving of the second actuator provided in each of the first thread guide adjusting unit and the second thread guide adjusting unit such that frictional force between the pair of thread guide units provided in the first thread guide adjusting unit is greater than frictional force between the pair of thread guide units provided in the second thread guide adjusting unit in a first section in which the thread take-up unit moves from a bottom dead center to a top dead center during one cycle where the needle bar is reciprocally driven, and the controller controls the driving of the second actuator provided in each of the first thread guide adjusting unit and the second thread guide adjusting unit such that the frictional force between the pair of thread guide units provided in the second thread guide adjusting unit is greater than the frictional force between the pair of thread guide units provided in the first thread guide adjusting unit in a second section other than the first section during one cycle where the needle bar is reciprocally driven.

In addition, the first actuator uses a driving motor provided with a position detecting means, and the second actuator uses one of a solenoid and a magnetic valve.

Specific matters of other embodiments are included in the detailed description and drawings.

Advantageous Effects of Invention

An embroidery machine thread tension adjusting device according to an embodiment of the present invention separately includes a thread pulling adjusting unit for adjusting an amount of pulling of an upper thread by an actuator, and thread guide adjusting units for providing a pair of thread guide units with pressing force by an actuator. By automatically controlling the driving of the thread pulling adjusting unit and the thread guide adjusting units according to the status of driving of a needle bar, a thread take-up unit, a hook, and an embroidery frame, the embroidery machine thread tension adjusting device according to an embodiment of the present invention may adjust the tension of the upper thread more easily and precisely by considering the speed of supply of the upper thread and the amount of consumption of the upper thread for various types of the upper thread, thereby preventing the upper thread from breaking, supplying the upper thread smoothly, and improving embroidery quality.

The effects of the present invention are not limited to the effects described above, and other effects that are not mentioned herein will be clearly understood from the description of the claims by those of ordinary skill in the art.

DESCRIPTION OF EMBODIMENTS

Figure 1:
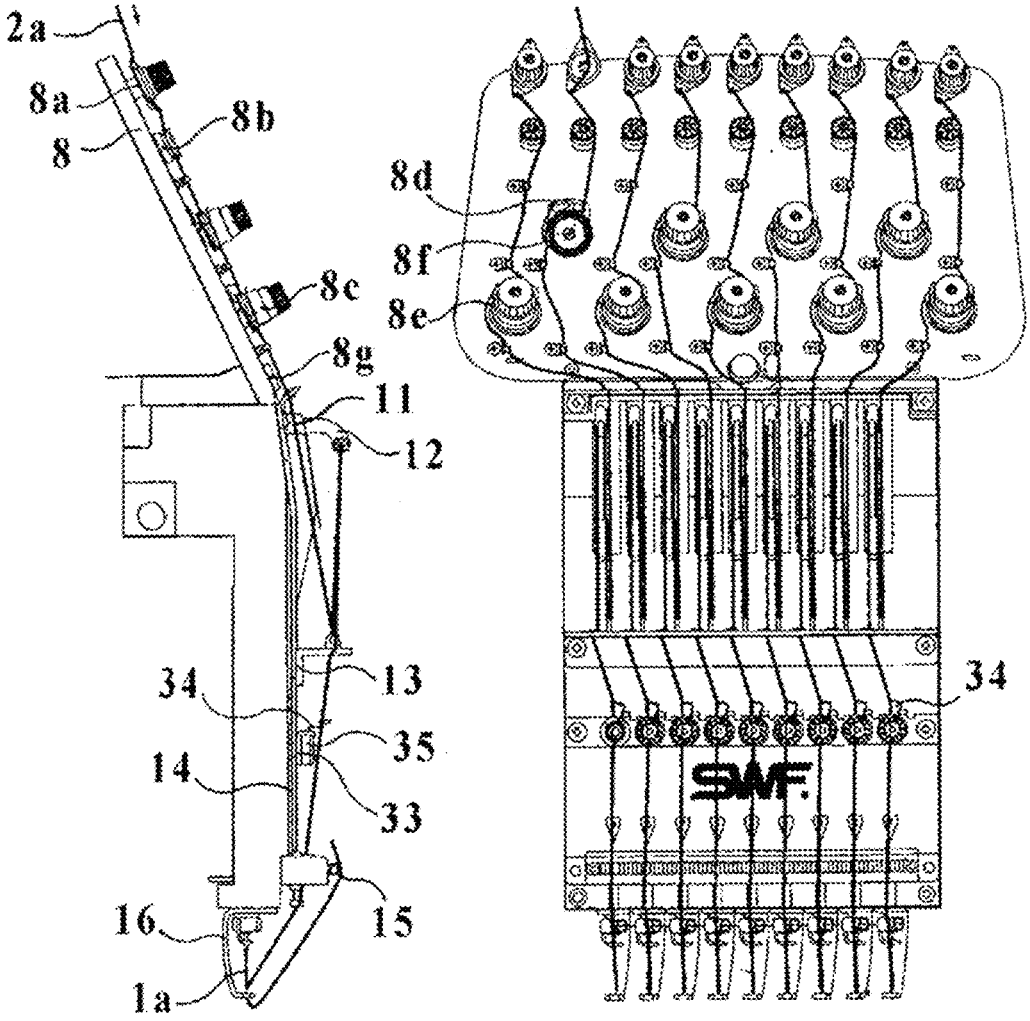
Prior Art FIG. 1
FIG. 1 is a diagram showing an example of a conventional thread tension adjusting device provided in an embroidery machine.

Hereinafter, preferred embodiments of the present invention will be described with reference to the accompanying drawings, so that those of ordinary skill in the art can easily carry out the present invention.

In describing the embodiments, descriptions of technical contents that are well known in the technical field to which the present invention pertains and are not directly related to the present invention will be omitted. By omitting unnecessary description, the disclosure may be described more clearly without obscuring the gist of the disclosure.

For the same reason, some elements in the accompanying drawings are exaggerated, omitted, or schematically illustrated. Also, the size of each element does not entirely reflect the actual size. The same reference numerals are assigned to the same or corresponding elements in the drawings.

In addition, the expressions and predicates used herein with respect to the terms such as device or element directions (for example, "front", "back", "up", "down", "top", "bottom", "left", "right", "lateral", and the like) are only used to simplify the description of the present invention, and do not simply indicate or imply that the related device or element should have a particular direction.

Hereinafter, the present invention will be described with reference to the drawings for explaining an embroidery machine thread tension adjusting device according to an embodiment of the present invention.

Figure 2:
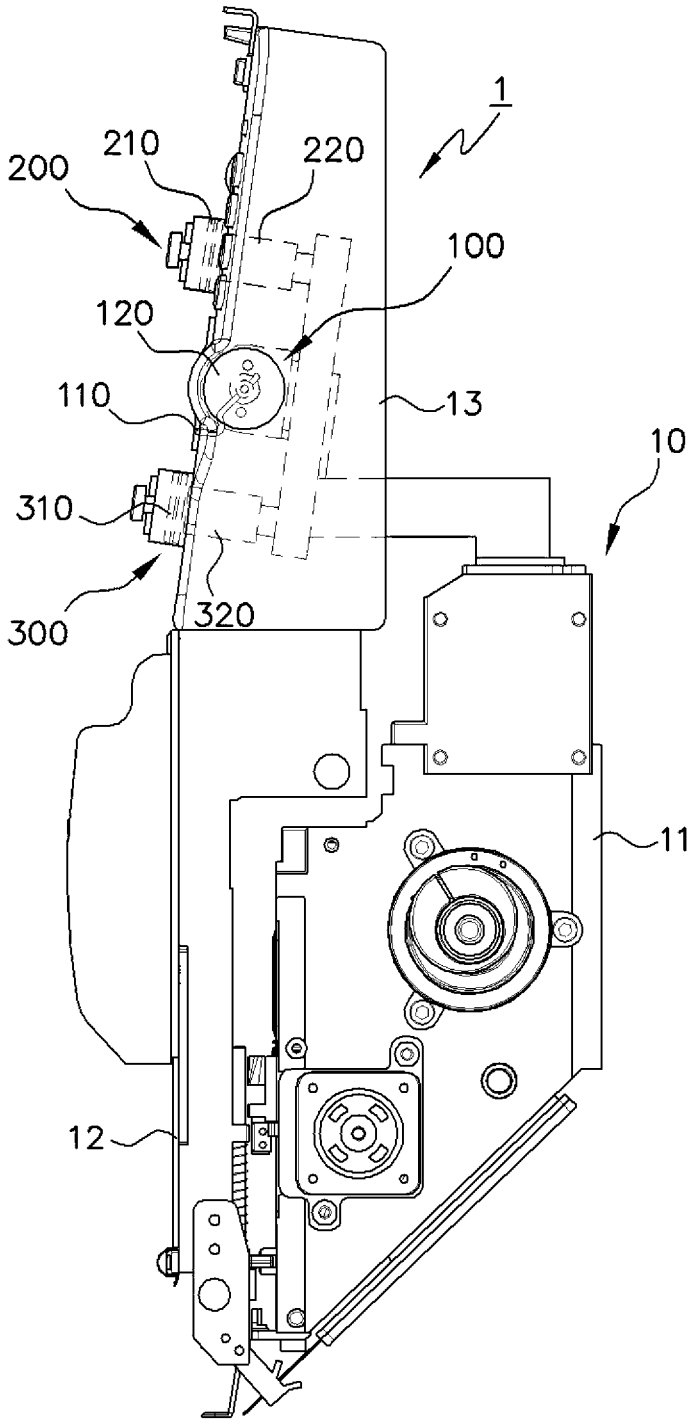
FIG. 2 is a side view showing a structure of an embroidery machine to which an embroidery machine thread tension adjusting device according to an embodiment of the present invention is applied.
Figure 3:
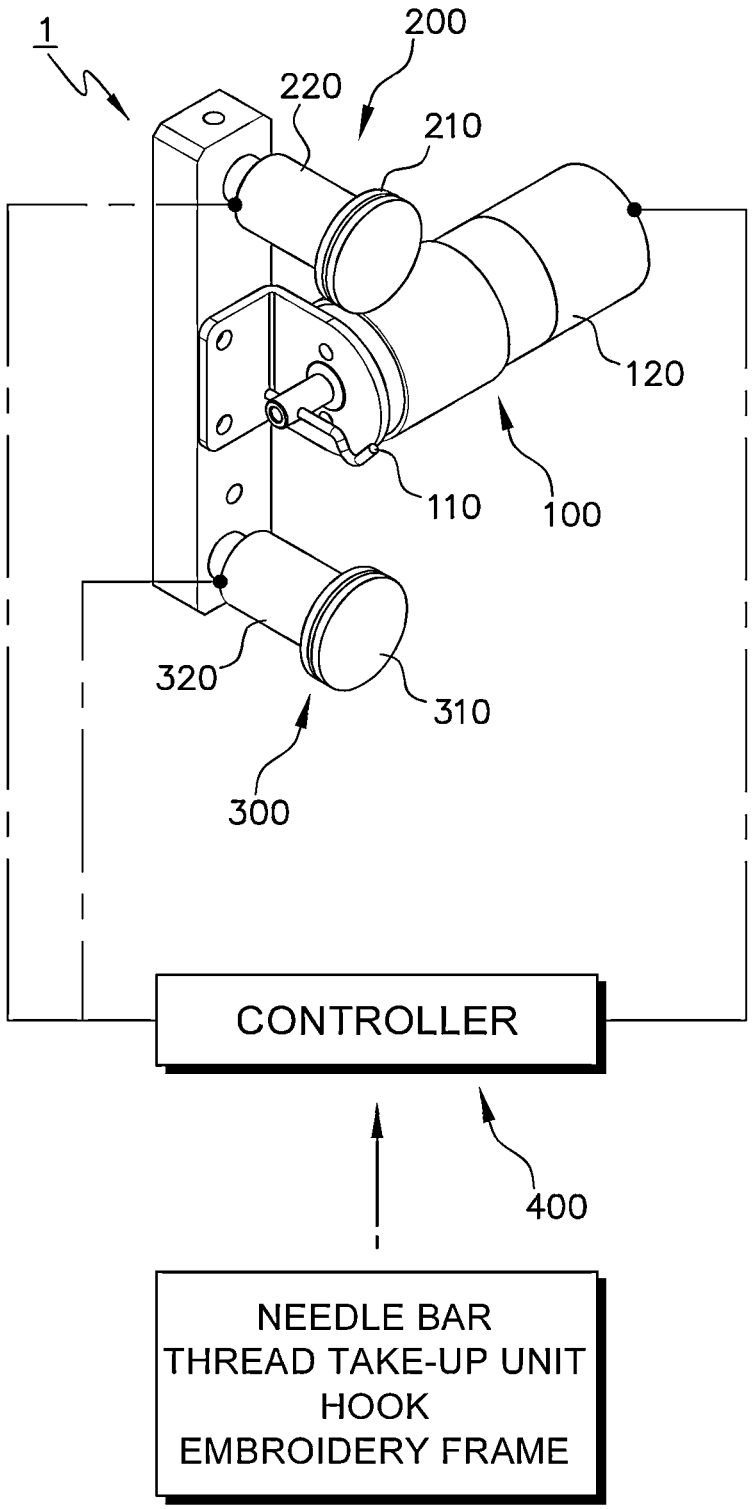
FIG. 3 is a perspective view showing the structure of the embroidery machine thread tension adjusting device according to an embodiment of the present invention.
Figure 4:
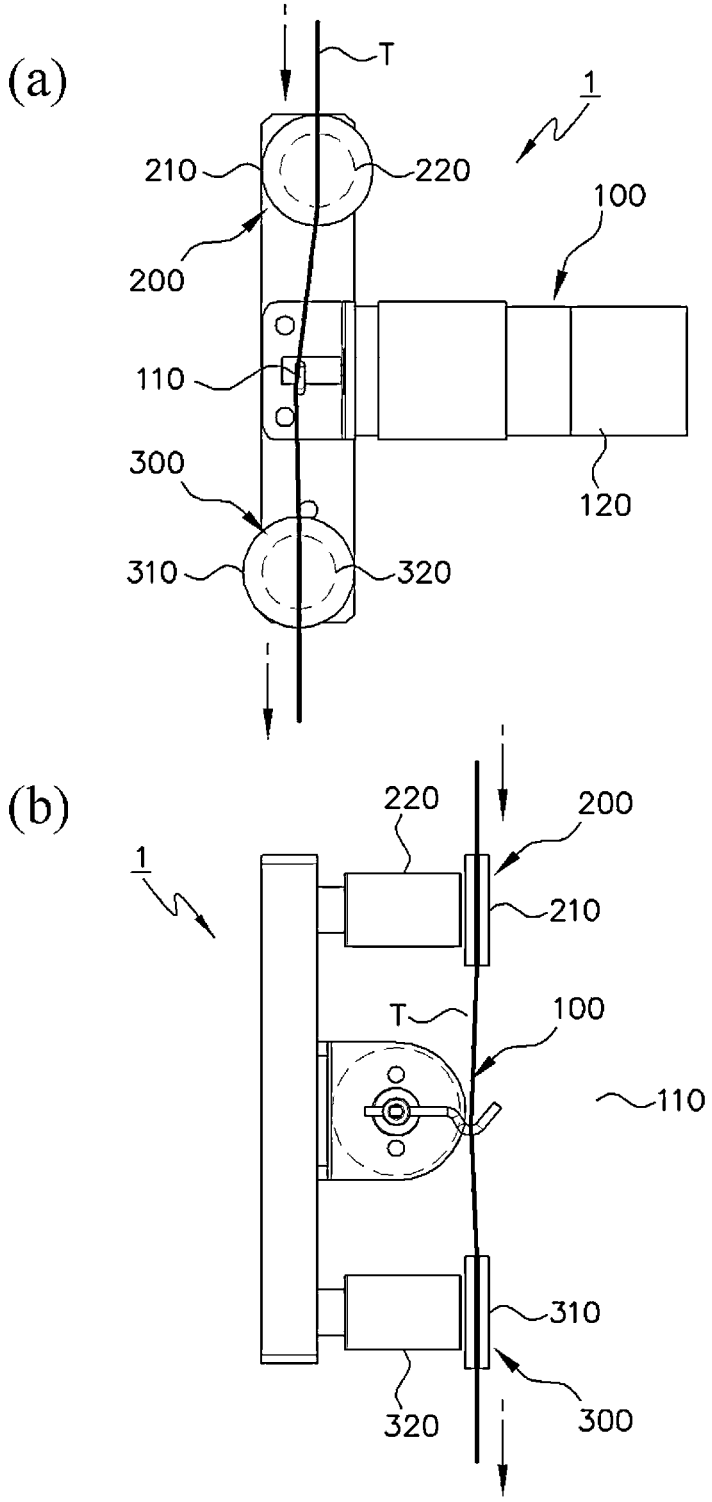
FIG. 4 is a diagram showing the structure of the embroidery machine thread tension adjusting device according to an embodiment of the present invention.

FIG. 2 is a side view showing a structure of an embroidery machine to which an embroidery machine thread tension adjusting device according to an embodiment of the present invention is applied, FIG. 3 is a perspective view showing the structure of the embroidery machine thread tension adjusting device according to an embodiment of the present invention, and FIG. 4 is a diagram showing the structure of the embroidery machine thread tension adjusting device according to an embodiment of the present invention.

As shown in FIG. 2, an embroidery machine thread tension adjusting device 1 according to an embodiment of the present invention may be provided for an embroidery machine 10 including a needle bar (not shown), a thread take-up unit (not shown), a hook (not shown), and an embroidery frame (not shown) and may be configured to adjust tension of an upper thread T withdrawn from a spool and supplied to a needle of the needle bar through the thread take-up unit. The embroidery machine thread tension adjusting device 1 may be installed inside a thread tension adjusting plate 13 provided on an upper end of a needle bar case 12 disposed in front of a sewing machine arm 11.

As shown in FIGS. 3 and 4, the embroidery machine thread tension adjusting device 1 according to an embodiment of the present invention may include a thread pulling adjusting unit 100, at least one thread guide adjusting unit 200 and 300, and a controller 400. (a) of FIG. 4 is a front view showing the structure of the embroidery machine thread tension adjusting device 1, and (b) of FIG. 4 is a side view showing the structure of the embroidery machine thread tension adjusting device 1.

The thread pulling adjusting unit 100 may be disposed along a path of movement of the upper thread T withdrawn from the spool and supplied to the needle and may be configured to include a thread take-up lever 110 and a first actuator 120.

The thread take-up lever 110 may control the amount of pulling of the upper thread T when rotating while maintaining contact with the upper thread T perpendicularly on the path of movement of the upper thread T, and the first actuator 120 may provide the thread take-up lever 110 with rotational driving power. Preferably, the first actuator 120 may use a driving motor. In this case, when the first actuator 120 is a driving motor, the driving motor may include a position detecting means for detecting the position (rotational angle) of the thread take-up lever 110.

The thread guide adjusting units 200 and 300 may be disposed on at least one of front and rear ends of the thread pulling adjusting unit 100 along the path of movement of the upper thread T and may be configured to include a pair of thread guide units 210 and 310 and second actuators 220 and 320.

The pair of thread guide units 210 and 310 may control the frictional force of the upper thread T when the upper thread T passes through spaces spaced apart from each other and the pair of thread guide units 210 and 310 are forced against each other while maintaining contact with the upper thread T, and the second actuators 220 and 320 may provide the pair of thread guide units 210 and 310 with driving power. Preferably, the second actuators 220 and 320 may use linear actuators such as solenoids and magnetic valves.

Preferably, as shown in FIGS. 3 and 4, the thread guide adjusting units 200 and 300 may be respectively provided on the front end and the rear end of the thread pulling adjusting unit 100 along the path of movement of the upper thread T with respect to the thread pulling adjusting unit 100.

That is, as shown in FIG. 4, the thread guide adjusting units 200 and 300 may include a first thread guide adjusting unit 200 disposed on the front end of the thread pulling adjusting unit 100 (in the example of FIG. 4, the upper end of the thread pulling adjusting unit 100) along the path of movement of the upper thread T, and a second thread guide adjusting unit 300 disposed on the rear end of the thread pulling adjusting unit 100 (in the example of FIG. 4, the lower end of the thread pulling adjusting unit 100) along the path of movement of the upper thread T.

Accordingly, the first thread guide adjusting unit 200 may guide the upper thread T withdrawn from the spool and supplied to the thread pulling adjusting unit 100 and may allow the pair of thread guiding unit 210 to provide the upper thread T with frictional force. In addition, the second thread guide adjusting unit 300 may guide the upper thread T supplied from the thread pulling adjusting unit 100 to the thread take-up unit and may allow the pair of thread guiding unit 310 to provide the upper thread T with frictional force.

As shown in FIGS. 3 and 4, the first thread guide adjusting unit 200 and the second thread guide adjusting unit 300 may be implemented with substantially the same structure, but may be independently controlled by the controller 400 according to the driving status of the needle bar, the thread take-up unit, the hook, and the embroidery frame. A method by which the controller controls the first thread guide adjusting unit 200 and the second thread guide adjusting unit 300 is described below with reference to FIG. 7.

As shown in FIG. 3, the controller 400 may be connected to a needle bar driver (not shown), a thread take-up unit driver (not shown), a hook driver (not shown), an embroidery frame driver (not shown), the thread pulling adjusting unit 100, and the at least one thread guide adjusting unit 200 and 300, and may receive driving information from the needle bar driver, the thread take-up unit driver, the hook driver, and the embroidery frame driver and control the thread pulling adjusting unit 100 and the at least one thread guide adjusting unit 200 and 300.

That is, the controller 400 may determine a status of driving of at least one of the needle bar, the needle take-up unit, the hook, and the embroidery frame according to each of multiple pieces of stitch information included in embroidery data, and then, may control the driving of at least one of the first actuator 120 and the second actuators 220 and 320 provided in each of the at least one thread guide adjusting unit 200 and 300 according to a result of determination.

The embroidery data refers to data, in which the X-axis and Y-axis movement distances of the embroidery frame are preset and stored, according to a type of upper thread, a stitch start position, a stitch shape (a straight shape, a zigzag shape, a cross progress shape, etc.), a stitch length/width/direction, a color of the upper thread, a work end position, a rotational angle of a driving shaft. In addition, the status of driving of the needle bar, etc. refers to the position of the needle bar, etc. according to the rotational angle of the driving shaft, the position of the needle bar, etc. according to the rotational speed of the driving shaft, and the like.

Therefore, the controller 400 may adjust at least one of the amount of pulling of the thread take-up lever 110 and the frictional force of the upper thread T supplied between the pair of thread guide units 210 and 310 provided in each of the at least one thread guide adjusting units 200 and 300 by adjusting the rotational angle of the thread take-up lever 110 provided in the thread pulling adjusting unit 100 and the degree of pressure between the pair of thread guide units 210 and 310 provided in each of the at least one thread guide adjusting unit 200 and 300.

Preferably, the controller 400 may control the driving of the first actuator 120 such that the thread take-up lever 110 maintains an initial angular position during one cycle where the needle bar is reciprocally driven. That is, when the thread take-up lever 110 rotates according to the status of supply of the upper thread T according to the movement of the needle bar and the thread take-up unit and attempts to deviate from the initial angular position, the controller 400 may control the driving of the first actuator 120 such that the thread take-up lever 110 can return to the initial angular position.

Figure 5:
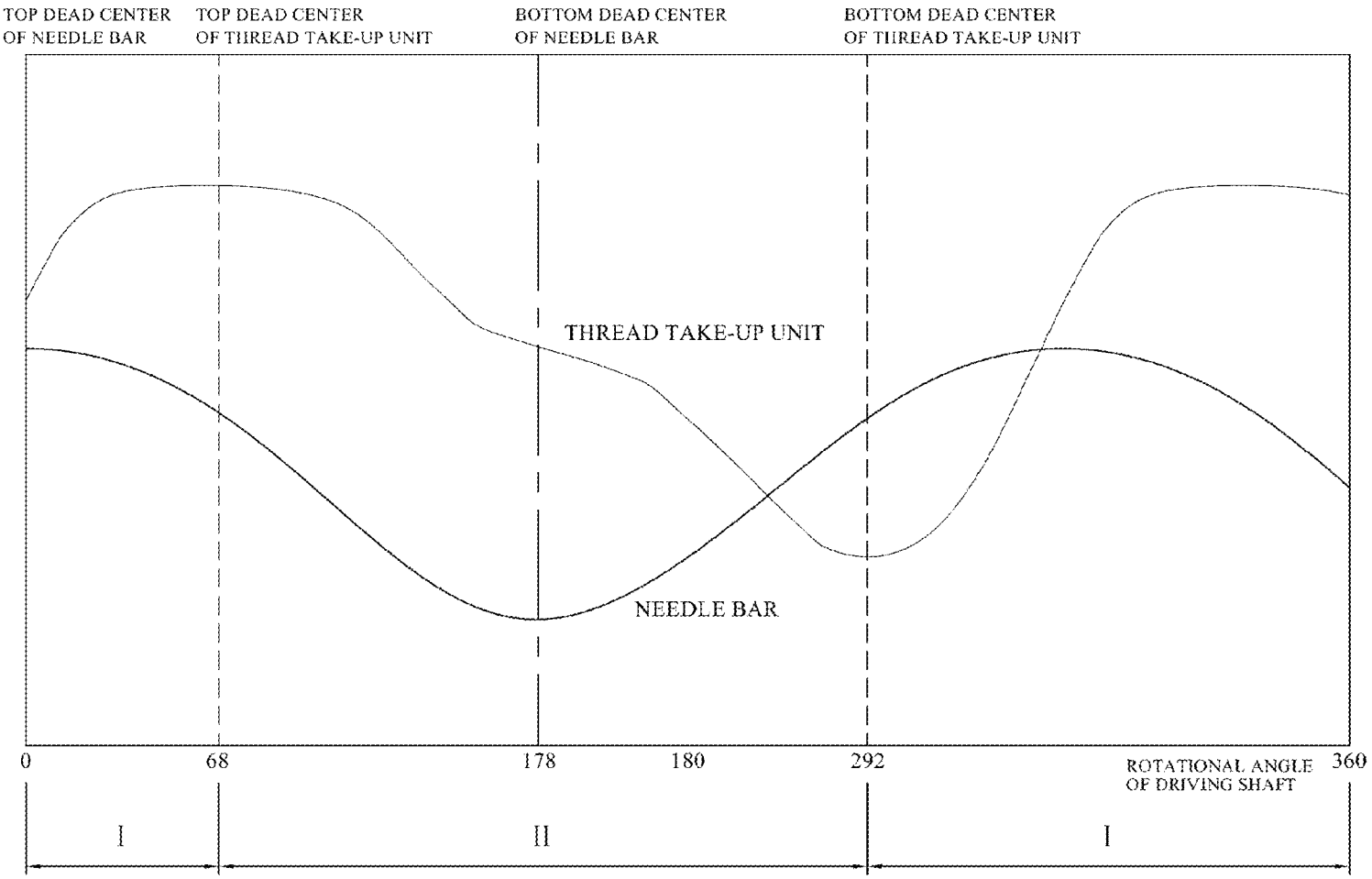
FIG. 5 is a diagram showing displacement curves of a needle bar and a thread take-up unit according to a rotational angle of a driving shaft for driving the needle bar during one cycle where the needle bar constituting the embroidery machine is reciprocally driven.
Figure 6:
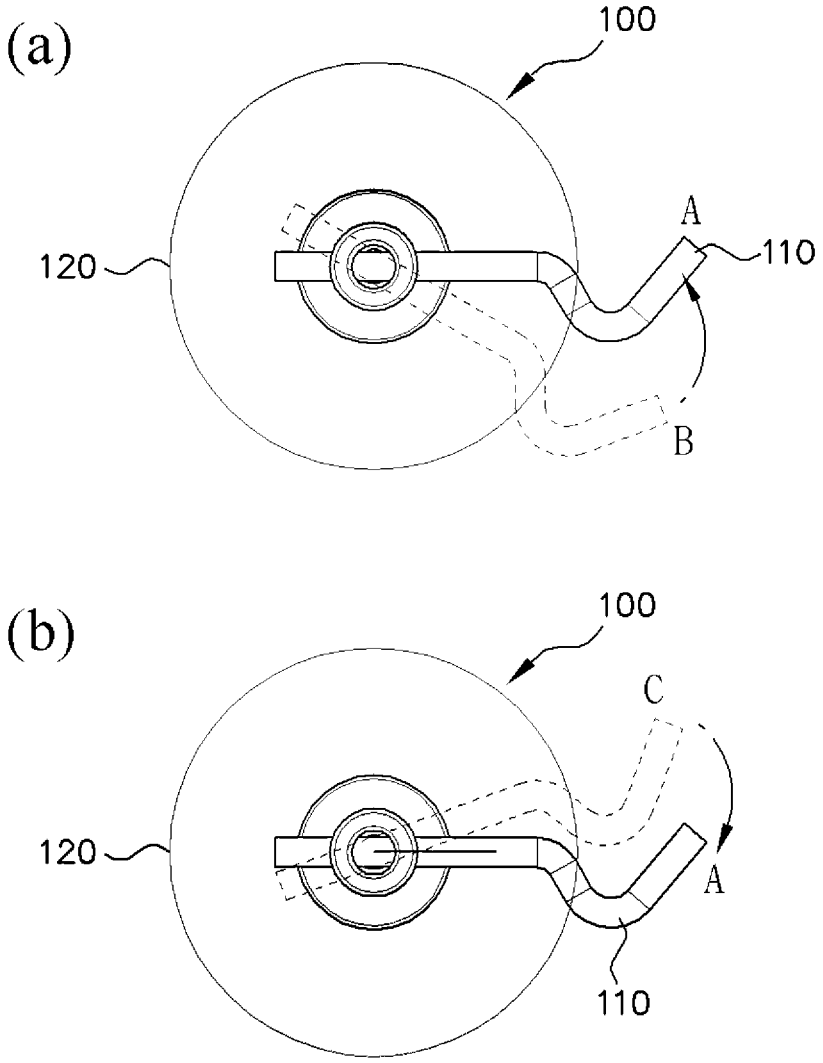
FIG. 6 is a diagram showing a state in which a controller of the embroidery machine thread tension adjusting device according to an embodiment of the present invention controls a thread pulling adjusting unit.

FIG. 5 is a diagram showing displacement curves of the needle bar and the thread take-up unit according to the rotational angle of the driving shaft for driving the needle bar during one cycle where the needle bar constituting the embroidery machine is reciprocally driven, and FIG. 6 is a diagram showing a state in which the controller of the embroidery machine thread tension adjusting device according to an embodiment of the present invention controls the thread pulling adjusting unit.

(a) of FIG. 6 shows the status of the thread take-up lever 110 according to the movement of the needle bar and the thread take-up unit in a first section (I) of the graph shown in FIG. 5, and (b) of FIG. 6 shows the status of the thread take-up lever 110 according to the movement of the needle bar and the thread take-up unit in a second section (II) of the graph shown in FIG. 5.

As shown in FIG. 5, the first section I and the second section II may be set based on the top dead center of the thread take-up unit (in the example of FIG. 5, the rotational angle of the driving shaft is 68 degrees) and the bottom dead center (in the example of FIG. 5, the rotational angle of the driving shaft is 292 degrees).

Preferably, the first section I may be set as one cycle where the needle bar is reciprocally driven, that is, a section where the thread take-up unit moves from the bottom dead center to the top dead center among the 360-degree rotation sections of the driving shaft for driving the needle bar. Therefore, in the example of FIG. 5, the first section I refers to a section where the rotational angle of the driving shaft is 0 degrees to 68 degrees and 292 degrees to 360 degrees (0 degrees), and the second section (II) refers to a section where the rotational angle of the driving shaft is 68 degrees to 292 degrees.

Meanwhile, the controller 400 may set the initial angular position A of the thread take-up lever 110 for each of multiple pieces of stitch information by using each of the multiple pieces of stitch information included in the embroidery data, and then, may control the driving of the first actuator 120 such that the thread take-up lever 110 maintains the initial angular position A during one cycle where the needle bar is reciprocally driven.

First, as shown in (a) of FIG. 6, when the thread take-up lever 110 rotates downward (clockwise in (a) of FIG. 6) by the upper thread T pulled by the thread take-up unit in the first section (I) and attempts to deviate from the initial angular position A (position B), the controller 400 may control the driving of the first actuator 120 such that the thread take-up lever 110 rotates counterclockwise and returns to the initial angular position A.

On the contrary, as shown in (b) of FIG. 6, when the thread take-up lever 110 rotates upward (clockwise in (b) of FIG. 6) by the upper thread T supplied to the thread take-up unit in the second section (II) and attempts to deviate from the initial angular position A (position C), the controller 400 may control the driving of the first actuator 120 such that the thread take-up lever 110 rotates clockwise and returns to the initial angular position A.

Therefore, even when the thread breaks during embroidery work, the thread take-up lever 110 can maintain the initial angular position A, and thus, the embroidery machine thread tension adjusting device 1 according to an embodiment of the present invention has an advantage of not only controlling the tension of the upper thread T more precisely, but also preventing damage to the thread take-up lever 110, etc.

Meanwhile, FIG. 5 shows an example in which the rotational angle of the driving shaft at the top dead center of the thread take-up unit is 68 degrees, and the rotational angle of the driving shaft at the bottom dead center is 292 degrees, but the present invention is not limited thereto, and the top dead center and the bottom dead center of the thread take-up unit may change according to the driving conditions of the embroidery machine 10. In addition, for convenience of explanation, (a) and (b) of FIG. 6 show an example in which the initial angular position A of the thread take-up lever 110 is horizontal, but the present invention is not limited thereto.

Meanwhile, the controller 400 constituting the embroidery machine thread tension adjusting device 1 according to an embodiment of the present invention may adjust the frictional force of the upper thread T supplied between the pair of thread guide units 210 and 310 provided in each of the at least one thread guide adjusting unit 200 and 300 according to the status of supply of the upper thread T based on the movement of the needle bar and the thread take-up unit.

Figure 7:
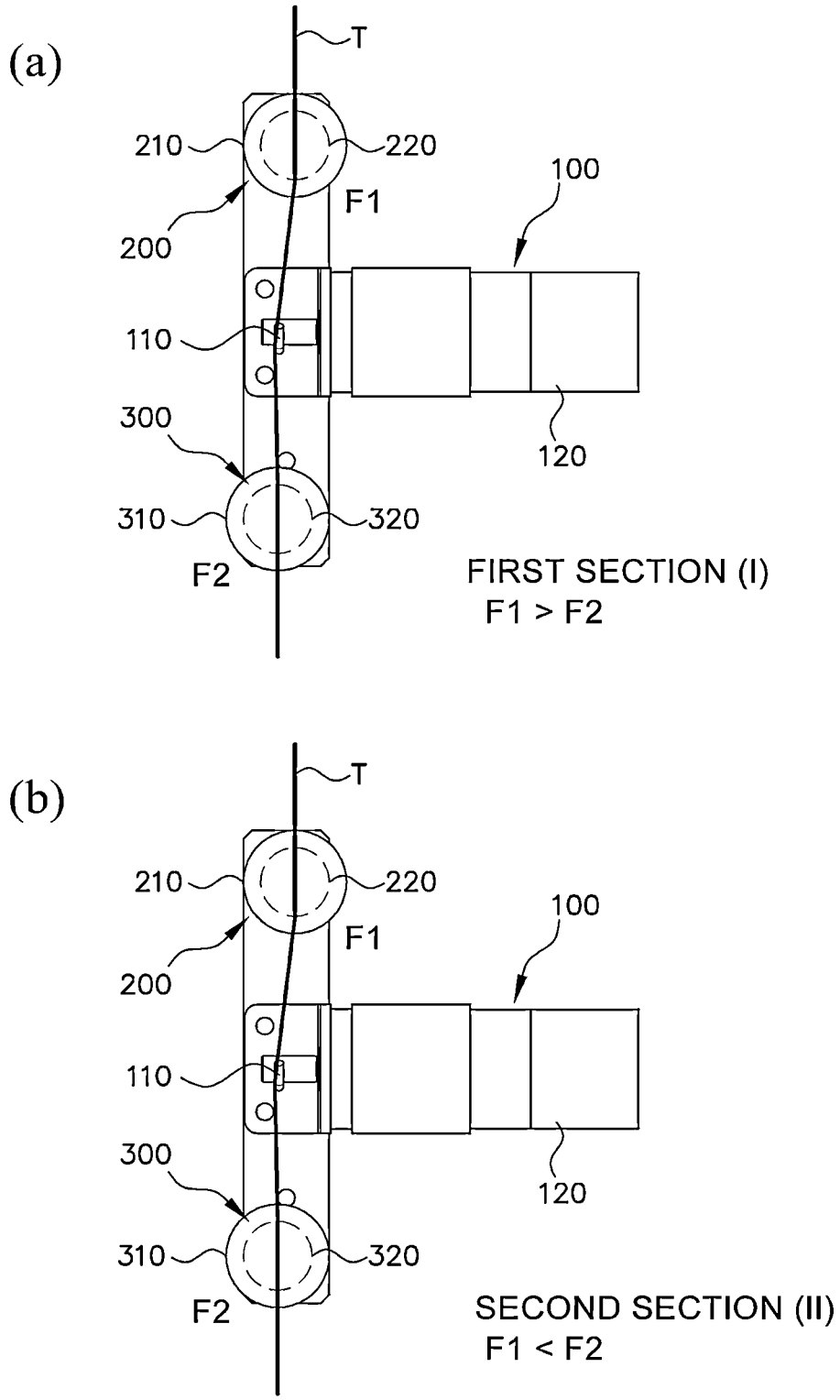
FIG. 7 is a diagram showing a state in which the controller of the embroidery machine thread tension adjusting device according to an embodiment of the present invention controls a thread guide adjusting unit.

FIG. 7 is a diagram showing a state in which the controller of the embroidery machine thread tension adjusting device according to an embodiment of the present invention controls the thread guide adjusting unit.

(a) of FIG. 7 shows a state in which the frictional force between the pair of thread guide units 210 and 310 provided in each of the thread guide adjusting units 200 and 300 is adjusted according to the movement of the needle bar and the thread take-up unit in the first section (I) of the graph shown in FIG. 5, and (b) of FIG. 7 shows a state in which the frictional force between the pair of thread guide units 210 and 310 provided in each of the thread guide adjusting units 200 and 300 is adjusted according to the movement of the needle bar and the thread take-up unit in the second section (II) of the graph shown in FIG. 5.

First, as shown in (a) of FIG. 7, when the thread take-up unit moves from the bottom dead center to the top dead center in the first section I, the controller 400 may control the driving of the second actuators 220 and 320 provided in each of the first thread guide adjusting unit 200 and the second thread guide adjusting unit 300 such that the frictional force F1 between the pair of thread guide units 210 provided in the first thread guide adjusting unit 200 is greater than the frictional force F2 between the pair of thread guide units 310 provided in the second thread guide adjusting unit 300.

Preferably, the driving of the second actuator 320 provided in the second thread guide adjusting unit 300 may be controlled such that no frictional force F2 exists between the pair of thread guide units 310 provided in the second thread guide adjusting unit 300, that is, the pair of thread guide units 310 are completely spaced apart from each other.

On the contrary, as shown in (b) of FIG. 7, when the thread take-up unit moves from the top dead center to the bottom dead center in the second section II, the controller 400 may control the driving of the second actuators 220 and 320 provided in each of the first thread guide adjusting unit 200 and the second thread guide adjusting unit 300 such that the frictional force F2 between the pair of thread guide units 310 provided in the second thread guide adjusting unit 300 is greater than the frictional force F1 between the pair of thread guide units 210 provided in the first thread guide adjusting unit 200.

Preferably, the driving of the second actuator 220 provided in the first thread guide adjusting unit 200 may be controlled such that no frictional force F1 exists between the pair of thread guide units 210 provided in the first thread guide adjusting unit 200, that is, the pair of thread guide units 210 are completely spaced apart from each other.

As shown in FIGS. 6 and 7, the embroidery machine thread tension adjusting device 1 according to an embodiment of the present invention has a structure that adjusts the tension of the upper thread T supplied from the spool to the needle by being disposed in the path of movement of the upper thread T, adjusting the amount of pulling of the upper thread T, and adjusting the frictional force of the upper thread T passing between the pair of thread guide units 210 and 310.

As such, the embroidery machine thread tension adjusting device 1 according to an embodiment of the present invention may separately include the thread pulling adjusting unit 100 for adjusting the amount of pulling of the upper thread T by the actuator, and the thread guide adjusting units 200 and 300 for providing the pair of thread guide units 210 and 310 with pressing force by the actuator. By automatically controlling the driving of the thread pulling adjusting unit 100 and the thread guide adjusting units 200 and 300 according to the status of driving of the needle bar, the thread take-up unit, the hook, and the embroidery frame, the embroidery machine thread tension adjusting device 1 according to an embodiment of the present invention may adjust the tension of the upper thread T more easily and precisely by considering the speed of supply of the upper thread T and the amount of consumption of the upper thread T for various types of the upper thread T, thereby preventing the upper thread T from breaking, supplying the upper thread T smoothly, and improving embroidery quality.

Meanwhile, in the present invention, the embroidery machine thread tension adjusting device has been described as an example, but the scope of application of the present invention is not limited thereto. The present invention is applicable to various types of machines and facilities that require the thread tension adjusting device, such as general sewing machines.

On the other hand, in the present specification and the drawings, preferred embodiments of the present disclosure are disclosed. Although certain terms are used, these terms are only used in a general sense to easily explain the technical content of the present disclosure and to help the understanding of the present disclosure, and are not intended to limit the scope of the present disclosure. It will be obvious to those of ordinary skill in the art that other modifications based on the technical idea of the present invention may be made thereto.

INDUSTRIAL APPLICABILITY

The present invention relates to an embroidery machine thread tension adjusting device, and more particularly, to an embroidery machine thread tension adjusting device that adjusts tension of an upper thread more easily and precisely by considering the supply speed of the upper thread and the amount of consumption of the upper thread for various types of upper threads, thereby preventing the upper thread from breaking, smoothly performing the supply of the upper thread, and improving embroidery quality.

The invention claimed is:

1. An embroidery machine thread tension adjusting device, adapted for an embroidery machine, including a needle bar, a thread take-up unit, a hook, and an embroidery frame and configured to adjust tension of an upper thread withdrawn from a spool and supplied to a needle of the needle bar through the thread take-up unit, the embroidery machine thread tension adjusting device comprising:

a thread pulling adjusting unit including a thread take-up lever disposed along a path of movement of the upper thread withdrawn from the spool and supplied to the needle configured to control an amount of pulling of the upper thread when rotating while maintaining contact with the upper thread, and a first actuator configured to provide a rotational driving power to the thread take-up lever;

at least one thread guide adjusting unit including at least one pair of thread guide units disposed on at least one of a first end and a second end of the thread pulling adjusting unit along the path of movement of the upper thread, the at least one pair of thread guide units configured to force against each other when the upper thread passes through spaces between the at least one pair of thread guide units and control a frictional force of the upper thread, and a second actuator configured to provide a driving power to the pair of thread guide units;

a controller configured to determine a status of driving of at least one of the needle bar, the needle take-up unit, the hook, and the embroidery frame according to each of multiple pieces of stitch information included in embroidery data, and control the driving of at least one of the first actuator and the second actuator disposed in each of the at least one thread guide adjusting unit according to a result of determination, and adjust at least one of the amount of pulling of the thread take-up lever and the frictional force of the upper thread supplied between the pair of thread guide units disposed in each of the at least one thread guide adjusting unit.

2. The embroidery machine thread tension adjusting device of claim 1, wherein the controller is configured to set an initial angular position of the thread take-up lever for each of the multiple pieces of stitch information, and control the driving of the first actuator, and wherein the thread take-up lever is configured to maintain the initial angular position during one complete reciprocal cycle of the needle bar.

3. The embroidery machine thread tension adjusting device of claim 2, wherein the at least one thread guide adjusting unit comprises:

a first thread guide adjusting unit disposed on the first end of the thread pulling adjusting unit along the path of movement of the upper thread and configured to guide the upper thread drawn from the spool and supplied to the thread pulling adjusting unit; and a second thread guide adjusting unit disposed on the second end of the thread pulling adjusting unit along the path of movement of the upper thread and configured to guide the upper thread supplied from the thread pulling adjusting unit to the thread take-up unit.

4. The embroidery machine thread tension adjusting device of claim 3, wherein, for the each of the multiple pieces of stitch information, the controller is configured to control the driving of the second actuator included in each of the first thread guide adjusting unit and the second thread guide adjusting unit, and frictional force between the at least one pair of thread guide units included in the first thread guide adjusting unit is configured to be greater than frictional force between the at least one pair of thread guide units included in the second thread guide adjusting unit in a first section, wherein the thread take-up unit is configured to move from a bottom dead center to a top dead center during one complete reciprocal cycle of the needle bar, and wherein the controller controls the driving of the second actuator included in each of the first thread guide adjusting unit and the second thread guide adjusting unit, and the frictional force between the at least one pair of thread guide units included in the second thread guide adjusting unit is configured to be greater than the frictional force between the at least one pair of thread guide units included in the first thread guide adjusting unit in a second section excluding the first section during the one complete reciprocal cycle of the needle bar.

5. The embroidery machine thread tension adjusting device of claim 1, wherein the first actuator is configured to use a driving motor equipped with a position detecting means, and the second actuator is configured to use one of a solenoid and a magnetic valve, wherein the position detecting means is configured to detect the position in a rotational angle of the thread take-up lever.

6. The embroidery machine thread tension adjusting device of claim 1, wherein the multiple pieces of stitch information included in the embroidery data includes data storing a preset X-axis and Y-axis movement distances of the embroidery frame according to a type of upper thread, a stitch start position, a stitch shape, a stitch length, a stitch width, a stitch direction, a color of the upper thread, a work end position, and a rotational angle of a driving shaft.

* * * * *